US008590741B2

(12) United States Patent
Hagleitner

(10) Patent No.: US 8,590,741 B2
(45) Date of Patent: Nov. 26, 2013

(54) DISPENSER FOR A FLOWABLE MEDIUM

(76) Inventor: Hans Georg Hagleitner, Zell Am See (AT)

( * ) Notice: Subject to any disclaimer, the term of this patent is extended or adjusted under 35 U.S.C. 154(b) by 269 days.

(21) Appl. No.: 12/940,254

(22) Filed: Nov. 5, 2010

(65) Prior Publication Data

US 2011/0108571 A1 May 12, 2011

Related U.S. Application Data

(63) Continuation of application No. PCT/AT2009/000139, filed on Apr. 8, 2009.

(30) Foreign Application Priority Data

May 5, 2008 (AT) ..... A 705/2008

(51) Int. Cl.
*B67D 1/00* (2006.01)

(52) U.S. Cl.
USPC ..... 222/25; 222/23; 222/39; 222/52; 222/63; 222/113; 222/638; 222/639

(58) Field of Classification Search
USPC ..... 222/39, 52, 63, 638–639, 113, 333, 25
See application file for complete search history.

(56) References Cited

U.S. PATENT DOCUMENTS

| | | | | |
|---|---|---|---|---|
| 4,722,372 | A | 2/1988 | Hoffman et al. | |
| 4,921,131 | A | 5/1990 | Binderbauer et al. | |
| 5,186,360 | A | 2/1993 | Mease et al. | |
| 5,477,984 | A * | 12/1995 | Sayama et al. | 222/52 |
| 5,810,201 | A * | 9/1998 | Besse et al. | 222/39 |
| 5,960,991 | A | 10/1999 | Ophardt | |
| 6,189,163 | B1 | 2/2001 | Van Marcke | |
| 6,390,329 | B1 | 5/2002 | Maddox | |
| 7,527,178 | B2 * | 5/2009 | Lewis | 222/333 |
| 7,909,209 | B2 * | 3/2011 | Reynolds et al. | 222/41 |
| 8,261,941 | B2 * | 9/2012 | Woo et al. | 222/52 |
| 8,261,950 | B2 * | 9/2012 | Cittadino et al. | 222/321.7 |
| 2005/0127099 | A1 | 6/2005 | Chou | |
| 2009/0101671 | A1 * | 4/2009 | Cittadino et al. | 222/23 |

FOREIGN PATENT DOCUMENTS

EP 0 341 747 A2 11/1989

OTHER PUBLICATIONS

International Search Report of PCT/AT2009/000139, Dated Jan. 19, 2010.

* cited by examiner

*Primary Examiner* — Frederick C Nicolas
(74) *Attorney, Agent, or Firm* — Laurence A. Greenberg; Werner H. Stemer; Ralph E. Locher

(57) ABSTRACT

A dispenser for a flowable medium, such as soap, foam soap or the like, has an outlet opening on the underside, a sensor in the region of the outlet opening, which sensor emits an electrical signal upon sensing a person, and an electrical pump which is caused to dispense a portion of the medium through the outlet opening as a result of the electrical signal from the sensor. A switch is also provided on the dispenser, the operation of which switch causes the next signal from the sensor to emit an optical or acoustic signal instead of dispensing a portion of the medium.

26 Claims, 1 Drawing Sheet

DISPENSER FOR A FLOWABLE MEDIUM

CROSS-REFERENCE TO RELATED APPLICATION

This is a continuation application, under 35 U.S.C. §120, of copending international application No. PCT/AT2009/000139, filed Apr. 8, 2009, which designated the United States; this application also claims the priority, under 35 U.S.C. §119, of Austrian patent application No. A 705/2008, filed May 5, 2008; the prior applications are herewith incorporated by reference in their entirety.

BACKGROUND OF THE INVENTION

Field of the Invention

The invention relates to a dispenser for a flowable medium, such as soap, foam soap or the like, having an outlet opening on the underside, having a sensor in the region of the outlet opening, which sensor emits an electrical signal upon sensing a person, and having an electrical pump which is caused to dispense a portion of the medium through the outlet opening as a result of the electrical signal from the sensor.

Soap dispensers with contactless automatic dispensing of soap as soon as a person is at the correct distance from the sensor have the disadvantage that the operation of cleaning an area which is under and close to the dispenser, for example a washbasin or the like, entails difficulties or becomes impossible if approaching the area to be cleaned results in a portion of soap or the like being dispensed.

SUMMARY OF THE INVENTION

It is accordingly an object of the invention to provide a dispenser for a flowable medium which overcomes the above-mentioned disadvantages of the prior art devices of this general type.

With the foregoing and other objects in view there is provided, in accordance with the invention a dispenser for a flowable medium, including soap, foam soap, or lotion. The dispenser contains a housing having an underside with an outlet opening and a sensor disposed in a region of the outlet opening. The sensor emits an electrical signal upon sensing a person. An electrical pump causes a dispensing of a portion of the flowable medium through the outlet opening as a result of the electrical signal from the sensor. An actuator selected from the group consisting of switches and pushbuttons is disposed on the housing. An operation of the actuator causes a next signal from the sensor to emit an optical signal or an acoustic signal instead of dispensing the portion of the flowable medium.

The invention has now set itself the object of finding a solution to this and proposes providing a switch or pushbutton on the dispenser, the operation of which switch or pushbutton causes the next signal from the sensor to emit an optical or acoustic signal instead of dispensing a portion of the medium.

This makes it possible to deactivate the metering pump which would be used to dispense the portion, and the intended measure can be carried out without the device spewing out soap, this being able to be heard and/or seen as a result of the substitute signal. If the measure has been concluded, the switch can be manually reset again. A timer, in particular an adjustable timer, is preferably associated with the pushbutton and restores the normal function after a time of 30 to 40 seconds, for example.

In this case in particular, the substitute signal may be helpful if the measure has lasted for only a few seconds and the subsequent, unsuspecting user would still like to trigger dispensing of soap within this time, since he then either already knows that a subsequent attempt shortly afterward will be successful or he is led to a next attempt which is then probably already successful. The display may be provided, for example, on an illuminable or flashing ring which surrounds the outlet opening. However, other possibilities are also conceivable, for example the display of a neon sign "Please wait" or the like.

The switch or pushbutton is preferably arranged in a depression on the underside of the dispenser, in particular such that it can be gripped by a finger, and is preferably in the form of a pushbutton. In order to ensure that the operation of the switch does not cause a portion of soap to be dispensed, the switch may be arranged at a sufficient lateral distance from the sensor, and/or a reflection light barrier, in particular with infrared light, may be provided, the two sensor elements of which, transmitter and receiver, are arranged on both sides of the outlet opening, with the result that said barrier only responds to central interruption.

Other features which are considered as characteristic for the invention are set forth in the appended claims.

Although the invention is illustrated and described herein as embodied in a dispenser for a flowable medium, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
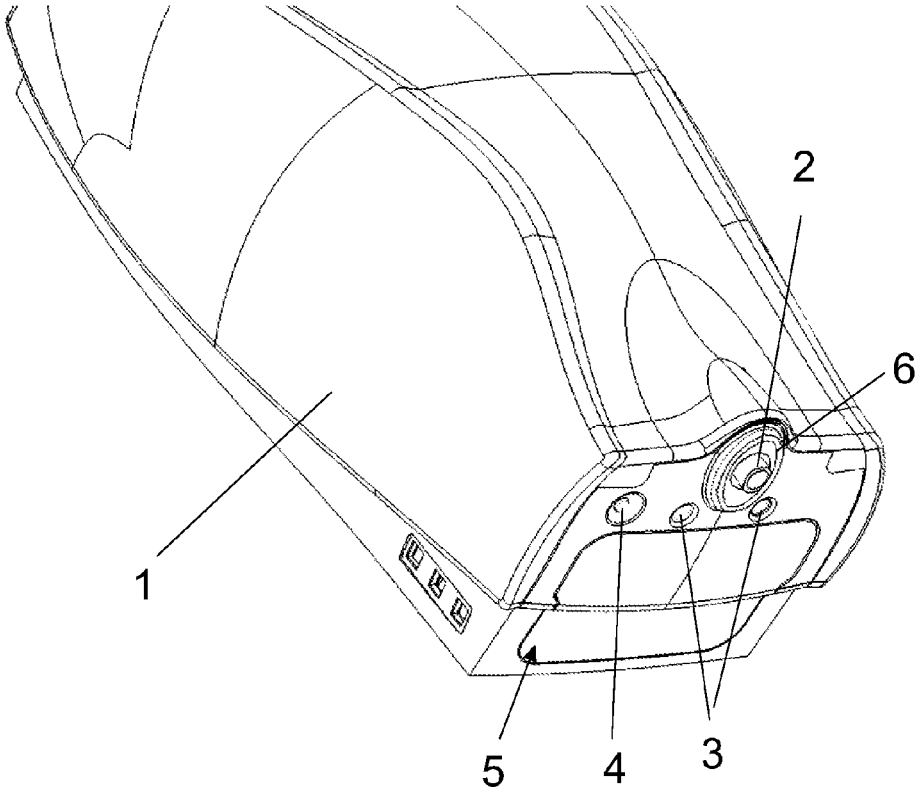
FIG. 1 is a diagrammatic, bottom perspective view of a dispenser for a flowable medium according to the invention.
Figure 2:
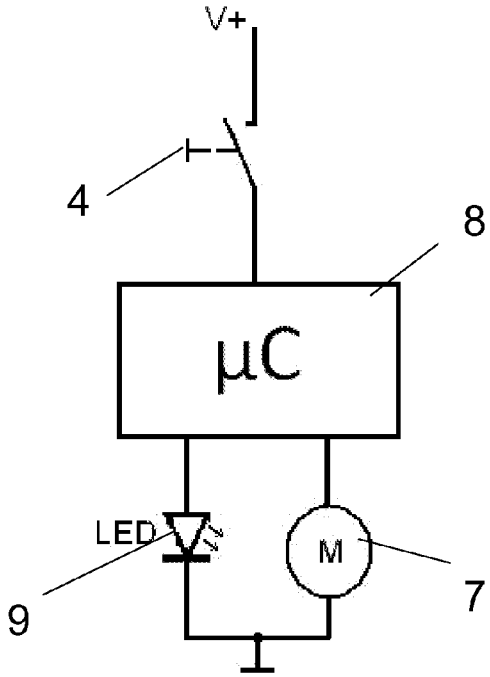
FIG. 2 is a schematic illustration of a circuit for changing to an optical or acoustic substitute signal.

Referring now to the figures of the drawing in detail and first, particularly, to FIG. 1 thereof, there is shown a dispenser 1 for soap, foam soap, hand cream or the like and is intended to be mounted on a wall in the vicinity of a washbasin or the like. On an underside 5, the dispenser 1 has an outlet opening 2 which is surrounded by a ring 6 which can be illuminated from the inside. Provided on both sides of the outlet opening 2 are transmitters and receivers of a reflection light barrier which is used as a sensor 3 for detecting an approaching person and emits an electrical signal which causes a pump driven by a motor 7 to dispense a portion of the medium. Provided at a distance beside the sensor 3 and, in particular, in a somewhat recessed manner is a switch or pushbutton 4 which, for a preferably adjustable period of time, causes a sensor signal to emit an optical signal in the ring 6 or an acoustic signal rather than dispensing a portion of the medium, which sensor signal is generated within the period. FIG. 2 shows a simplified circuit diagram. A microcontroller 8 having a timer drives a light-emitting diode 9 arranged in the ring 6 instead of the motor 7 of the pump when the pushbutton 4 is operated.

After the switch or pushbutton 4 has been operated, this allows undisrupted movement of a cleaner, for example, under the dispenser on the washbasin or the like for 30 to 40 seconds, for example.

The invention claimed is:

1. A dispenser for a flowable medium, including soap, foam soap, or lotion, the dispenser comprising:
- a housing having an underside with an outlet opening formed therein;
- a sensor in a region of said outlet opening, said sensor emitting an electrical signal upon sensing a person;
- an electrical pump causing a dispensing of a portion of the flowable medium through said outlet opening as a result of the electrical signal from said sensor; and
- an actuator selected from the group consisting of switches and pushbuttons disposed on said housing, an operation of said actuator causing a next signal from said sensor to emit an optical signal or an acoustic signal instead of dispensing the portion of the flowable medium.

2. The dispenser according to claim 1, further comprising a timer connected to said pushbutton.

3. The dispenser according to claim 1, wherein said actuator is disposed on said underside of said housing.

4. The dispenser according to claim 3, wherein said actuator is disposed at a lateral distance from said sensor.

5. The dispenser according to claim 1, wherein said sensor is an infrared reflection light barrier.

6. The dispenser according to claim 1, further comprising an illuminable ring surrounding said outlet opening and emitting an optical signal.

7. The dispenser according to claim 1, further comprising an adjustable timer connected to said pushbutton.

8. The dispenser according to claim 1, wherein said underside of said housing has a depression formed therein, said actuator is disposed in said depression.

9. A dispenser for a flowable medium, including soap, foam soap, or lotion, the dispenser comprising:
- a housing having an underside with an outlet opening formed therein, said housing further having an illuminable ring surrounding said outlet opening;
- a sensor in a region of said outlet opening, said sensor emitting an electrical signal upon sensing a person;
- an electrical pump causing a dispensing of a portion of the flowable medium through said outlet opening as a result of the electrical signal from said sensor; and
- an actuator selected from the group consisting of switches and pushbuttons disposed on said housing, an operation of said actuator causing a next signal from said sensor to emit an optical signal via said illuminable ring instead of dispensing the portion of the flowable medium.

10. The dispenser according to claim 9, wherein said actuator is disposed on said underside of said housing.

11. The dispenser according to claim 9, wherein said actuator is disposed at a lateral distance from said sensor.

12. The dispenser according to claim 9, wherein said sensor is an infrared reflection light barrier.

13. The dispenser according to claim 9, further comprising an adjustable timer connected to said pushbutton.

14. The dispenser according to claim 9, wherein said underside of said housing has a depression formed therein, said actuator is disposed in said depression.

15. A dispenser for a flowable medium, including soap, foam soap, or lotion, the dispenser comprising:
- a housing having an underside with an outlet opening and depression formed therein;
- a sensor in a region of said outlet opening, said sensor emitting an electrical signal upon sensing a person;
- an electrical pump causing a dispensing of a portion of the flowable medium through said outlet opening as a result of the electrical signal from said sensor; and
- an actuator selected from the group consisting of switches and pushbuttons disposed in said depression in said underside of said housing at a lateral distance from said sensor, an operation of said actuator causing a next signal from said sensor to emit an optical signal or an acoustic signal instead of dispensing the portion of the flowable medium.

16. The dispenser according to claim 15, wherein said sensor is an infrared reflection light barrier.

17. The dispenser according to claim 15, further comprising an illuminable ring surrounding said outlet opening and emitting an optical signal.

18. The dispenser according to claim 15, further comprising an adjustable timer connected to said pushbutton.

19. A dispenser for a flowable medium, including soap, foam soap, or lotion, the dispenser comprising:
- a housing having an underside with an outlet opening formed therein;
- a sensor in a region of said outlet opening, said sensor emitting an electrical signal upon sensing a person;
- an electrical pump causing a dispensing of a portion of the flowable medium through said outlet opening as a result of the electrical signal from said sensor; and
- an actuator selected from the group consisting of switches and pushbuttons disposed on said housing, an operation of said actuator causing a next signal from said sensor to emit an acoustic signal instead of dispensing the portion of the flowable medium.

20. The dispenser according to claim 19, further comprising a timer connected to said pushbutton.

21. The dispenser according to claim 19, wherein said actuator is disposed on said underside of said housing.

22. The dispenser according to claim 19, wherein said actuator is disposed at a lateral distance from said sensor.

23. The dispenser according to claim 19, wherein said sensor is an infrared reflection light barrier.

24. The dispenser according to claim 19, further comprising an illuminable ring surrounding said outlet opening.

25. The dispenser according to claim 19, further comprising an adjustable timer connected to said pushbutton.

26. The dispenser according to claim 19, wherein said underside of said housing has a depression formed therein, said actuator is disposed in said depression.

* * * * *